United States Patent [19]

Gingher, Jr.

[11] Patent Number: 4,759,127

[45] Date of Patent: Jul. 26, 1988

[54] CUTTING INSTRUMENT WITH BREAKAWAY FINGER LOOP

[76] Inventor: Clair H. Gingher, Jr., P.O. Box 8865, Greensboro, N.C. 27410

[21] Appl. No.: 2,276

[22] Filed: Jan. 12, 1987

[51] Int. Cl.[4] ..... B26B 13/00

[52] U.S. Cl. ..... 30/232; 30/341

[58] Field of Search ..... 30/198, 232, 298, 320, 30/324, 341; 81/177.3

[56] References Cited

U.S. PATENT DOCUMENTS

| | | | |
|---|---|---|---|
| 2,158,277 | 5/1939 | Dolph | 30/341 |
| 2,418,638 | 4/1947 | Hoover | 81/177.3 |
| 2,707,828 | 5/1955 | Stewart | 30/298 X |

*Primary Examiner*—Douglas D. Watts

*Attorney, Agent, or Firm*—Rhodes, Coats & Bennett

[57] ABSTRACT

A cutting instrument, such as a thread nipper, is provided with a safety breakaway finger loop. In use should the cutting instrument inadvertently be engaged and pulled into a textile machine, for example, the finger loop engaging the hand of the user will automatically breakaway from the body of the cutting instrument.

6 Claims, 1 Drawing Sheet

CUTTING INSTRUMENT WITH BREAKAWAY FINGER LOOP

FIELD OF THE INVENTION

The present invention relates to cutting instruments such as scissors, thread nippers, etc., and more particularly to a breakaway finger loop for such cutting instruments.

BACKGROUND OF THE INVENTION

Cutting instruments of all types, including scissors, thread nippers, and cutting instruments employing cooperating pivoting blades, typically employ a finger or thumb loop. A finger or thumb loop can be beneficial as it enables the user to securely hold the cutting instrument and assists the user in controlling the instrument during use.

However, finger or thumb loops secured to a cutting instrument do have drawbacks and disadvantages. For example, cutting instruments of the type being discussed are widely used in and around textile machinery. In fact they are used to cut thread, yarn, etc., in close proximity to these machines. This may present a safety hazard inasmuch as the potential may exist for the cutting instrument to be inadvertently projected into a machine and for the machine to in turn pull the cutting instrument into it. This presents a concern for the user.

Moreover, there are many users of cutting instruments such as a thread nipper that consider a finger or thumb loop to be totally unnecessary. In such cases the presence of a finger or thumb loop hinder effective and efficient use of the cutting instrument. There are many users of cutting instruments, especially cutting instruments of the thread nipper type who prefer not to have a finger or thumb loop structure extending from the body of the cutting instrument.

Thus, there has been and continues to be a need for a "breakaway" finger or thumb loop for use in conjunction with cutting instruments of the type being discussed above. Such a breakaway finger or thumb loop would reduce the potential risk of a user's hand being drawn into a machine. In addition, it would enable the user to make use of the cutting instrument with or without the finger loop attached.

SUMMARY AND OBJECTS OF THE INVENTION

The present invention presents a cutting instrument with a "breakaway" finger loop. In particular, a "breakaway" finger loop is provided and is adapted to be attached to the body of a cutting instrument such that the finger loop itself will breakaway from the body of the cutting instrument in response to a predetermined force being applied to the finger loop and directed away from the cutting instrument.

It is therefore, an object of the present invention to provide a cutting instrument with a finger loop that includes a breakaway attaching structure that permitts the finger loop to breakaway from the cutting instrument in response to a predetermined amount of force being directed against the finger loop away from the cutting instrument, or vice versa.

Another object of the present invention resides in the provision of a cutting instrument that is provided with a detachable finger loop that enables the user to use the cutting instrument with or without the finger loop attached.

Another object of the present invention is to provide a cutting instrument of the character referred to above that includes a "breakaway" or detachable finger loop that enables the finger loop to be positioned at various locations on the cutting instrument to accommodate the particular wishes of the user.

Another object of the present invention resides in the provision of a cutting instrument of the type having a pair of cooperating pivoting blades, with a breakaway finger loop that includes a plurality of projectors that connect the finger loop with a body portion of the cutting instrument to form a secure frictional fit and wherein the frictional fit is such that will under normal use and circumstances maintain the finger loop in a secured attached position with respect to the cutting instrument but which will yield and breakaway from the cutting instrument in response to a predetermined amount of force being applied to the loop and directed away from the cutting instrument.

It is also an object of the present invention to provide a breakaway finger loop for a cutting instrument of the character referred to above, that is simple in design and which can be manufactured relatively easy.

Other objects and advantages of the present invention will become apparent and obvious from a study of the following description and the accompanying drawings which are merely illustrative of such invention.

DETAILED DESCRIPTION OF THE INVENTION

With further reference to the drawings, a cutting instrument is shown therein and indicated generally by the numeral 10. While the breakaway finger loop of the present invention can be used with cutting instruments of all types, in the present disclosure the cutting instrument shown is what is generally referred to as a thread nipper.

The cutting instrument or thread nipper 10 includes a body portion that is provided with a pair of pivotably mounted blade holders 12 and 14. Blades 16 and 18 are attached to one end of the blade holders 12 and 14. Although not shown, the blade holders 12 and 14 and the respective blades 16 and 18 are biased so as to normally assume an open position. Other details of the cutting instrument or thread nipper 10 are not dealt with here in detail because such is not per se material to the present invention and because thread nippers of the type shown and other cooperating pivoting blade cutting means are well-known and appreciated in the art.

Figure 1:
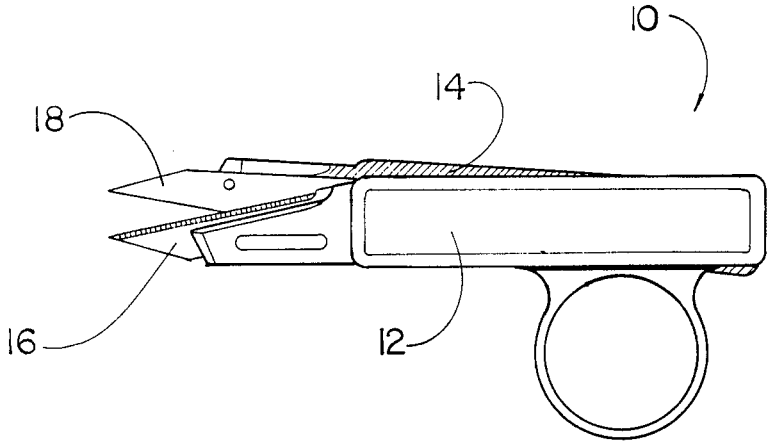
FIG. 1 is a side elevational view of a cutting instrument, in this case a thread nipper, having the breakaway finger loop of the present invention attached thereto in a secured position.
Figure 2:
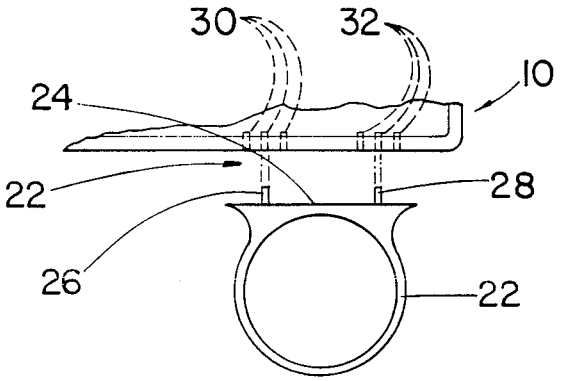
FIG. 2 is a fragmentary side elevational view showing the finger loop of the present invention in a detached or "broken away" position from the cutting instrument.

The present invention entails a breakaway finger loop for use with the cutting instrument 10. With reference to FIG. 2, there is shown therein a finger loop breakaway that is indicated generally by the numeral 20.

Viewing finger loop breakaway 20 in more detail it is seen that the same comprises a finger loop 22. The term finger loop is meant to include any type of loop, partial or full loop, which is designed to receive an individual's finger or thumb.

Finger loop 22 includes an upper flat attaching surface 24. Extending outwardly from the flat attaching surface 24 is a pair of breakaway connectors or projectors 26 and 28.

Formed in the body of the cutting instrument 10 are the breakaway retaining means. In the case of the present disclosure the breakaway retaining means comprise two sets of openings, each set including three separate openings. As shown in FIG. 2 the first set of three openings is referred to by the numeral 30 while the second set of three openings is referred to by the numeral 32.

The openings 30 and 32 and the breakaway connectors 26 and 28 are particularly designed to create a frictional fit between the openings and the projectors. In particular, the openings 30 and 32 are of a diameter just slightly greatly than the diameter of the projectors 26 and 28. The diameters of the openings 30 and 32 are formed such that a tight frictional fit is generated between the projectors 26 and 28 and the openings 30 and 32.

Once the breakaway connectors or projectors 26 and 28 have been projected into respected openings 30 and 32 a tight and secure fit is realized. In fact, the frictional fit is such that the finger loop 22 assumes a secured and attached position to the body of the cutting instrument 10 and will not fall and detach itself therefrom easily or due to its own weight. Effectively the frictional fit is sufficient to maintain a secure fit for normal use of the cutting instrument 10.

The frictional fit resulting from the openings 30 and 32 and the breakaway connectors or projectors 26 and 28 is such that the finger loop 22 can be pulled from the body of the cutting instrument 10. In fact, the design is such that a substantial or appreciable pulling force applied to the finger loop 22 and directed away from the cutting instrument 10 would be sufficient to breakaway or release the finger loop 22 from the body of the cutting instrument. This is particularly important in the event that the cutting instrument is caught and pulled into a textile machine, for example. If such should occur, the force resulting from the resistance of the user's hand would effectively pull the finger loop 22 from the body of the cutting instrument 10 thereby enabling the user's hand to escape injury.

Because of the two sets of openings, 30 and 32, it is appreciated that the finger loop can be positioned in a series of locations along the body of the cutting instrument 10. This would enable the user to adjust the position of the finger loop to his or her satisfaction.

In addition, it is appreciated that the breakaway finger loop 20 enables the user of the cutting instrument to use the same with or without the finger loop attached.

From the forgoing specification and discussion, it is seen that the present invention presents a breakaway finger loop 20 for a cutting instrument. The breakaway cutting loop serves a safety purpose as well as a utility purpose. Again, as pointed out above, the breakaway finger loop will tend to prevent a user's hand from being pulled into a textile machine in the event that the cutting instrument itself is pulled into the machine. Moreover the breakaway finger loop design of the present invention enables a user to choose whether he or she desires to have the finger loop attached in the first place. Beyond that the present design enables the finger loop to be positioned on the cutting instrument at a desired location. Finally, the finger loop assembly of the present invention is relatively simply in design and can be easily manufactured.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. In a cutting instrument having a body including a handgripping area and a pair of pivotably mounted blades, the improvement comprising: a finger loop breakaway therefore for permitting the finger loop to be pulled and separated from the body of the cutting instrument in emergency situations such as when the cutting instrument is inadvertently caught and pulled into a moving part of a machine, the finger loop and associated breakaway comprising:

(a) a finger loop;

(b) breakaway connector means extending from said finger loop and adapted to be connected to the body of the cutting instrument, said breakaway connector means including pin means extending from the finger loop; and (c) opening means formed on said cutting instrument's body for normally receiving and retaining the pin means such that the finger loop normally assumes an attached position on the cutting instrument but wherein the pin means includes means for releasing the pin means in response to a predetermined pulling force being applied to the finger loop and directed away from the body of the cutting instrument such that the finger loop will automatically be separated from the cutting instrument in emergency cases where the cutting instrument is pulled into a machine, for example.

2. The improved cutting instrument of claim 1 wherein said pin means includes a series of spaced apart pins of a selected shape and size; and wherein said opening means includes a series of openings formed in the body of the cutting instrument and particularly spaced and sized to frictionally receive the pins wherein the frictional fit between the pins and openings is sufficient to secure the finger loop firmly to the body of the cutting instrument during normal use but which will permit the finger loop to breakaway from the body of the cutting instrument in emergency situations.

3. The improved cutting instrument of claim 2 including means for adjusting the position of the finger loop on the body of the cutting instrument.

4. The improved cutting instrument of claim 3 wherein said means for adjusting the position of the finger loop on the body of the cutting instrument is provided by providing a greater number of retaining openings than pins thereby enabling the finger loop to be secured at various positions on the body of the cutting instrument.

5. In a thread nipper of the type having a body including a pair of movable blades, the improvement comprising a finger loop and a breakaway therefore for permitting the finger loop to breakaway from the body of the cutting instrument in response to a pulling force being applied to the finger loop and directed away from the body of the cutting instrument or vice versa, comprising:

(a) a finger loop;

(b) a series of spaced apart pins extending from the finger loop and being of a selected length and cross sectional area; and (c) a series of retaining openings formed in the body of the thread nipper for receiving the series of pins, said openings being particularly sized to receive the projectors and to form a frictional secured fit between the openings and the respective pins, the resulting frictional fit being capable of securing and retaining the finger loop to the body of the thread nipper for normal cutting use but wherein the frictional secured fit is capable of being overcome by a substantial pulling force such that in the event the thread nipper is pulled into a textile machine, for example, the finger loop will breakaway from the body of the thread nipper so as to prevent the user's hand from being pulled into the same machine.

6. The improved thread nipper of claim 5 wherein said retaining openings are aligned and wherein the number of retaining openings exceed the number of pins such that the finger loop can be adjustably positioned at a convenient location on the body of the thread nipper.

* * * * *